US012037794B1

(12) United States Patent
Rayburn

(10) Patent No.: US 12,037,794 B1
(45) Date of Patent: Jul. 16, 2024

(54) LOUVERED ENCLOSURE SYSTEM

(71) Applicant: Micah Rayburn, Boca Raton, FL (US)

(72) Inventor: Micah Rayburn, Boca Raton, FL (US)

( * ) Notice: Subject to any disclaimer, the term of this patent is extended or adjusted under 35 U.S.C. 154(b) by 361 days.

(21) Appl. No.: 16/951,765

(22) Filed: Nov. 18, 2020

Related U.S. Application Data

(60) Provisional application No. 62/936,989, filed on Nov. 18, 2019.

(51) Int. Cl.
*E04F 10/10* (2006.01)
*E04B 7/16* (2006.01)
(Continued)

(52) U.S. Cl.
CPC ..... *E04F 10/10* (2013.01); *E04B 7/163* (2013.01); *E04F 10/08* (2013.01); *E04F 13/072* (2013.01); *E04F 13/0823* (2013.01)

(58) Field of Classification Search
CPC ..... E06B 9/362; E06B 7/096; E04B 7/166; E04B 7/163; E04F 13/088; E04F 13/0883; E04F 10/08; E04F 10/10; E04F 13/07; E04F 13/072; E04F 13/0817; E04F 13/0823; E04F 13/0825
See application file for complete search history.

(56) References Cited

U.S. PATENT DOCUMENTS 2,957,520 A * 10/1960 Howard ..... E06B 9/302 160/113
3,280,891 A * 10/1966 Eldredge, Jr. ..... E06B 9/361 160/901
(Continued)

FOREIGN PATENT DOCUMENTS

EP 2730714 B1 * 7/2016 ..... E04B 7/163
WO WO-2015011263 A1 * 1/2015 ..... E04F 10/10
(Continued)

OTHER PUBLICATIONS

"Renson Skye Retractable Louvre System" found at https://www.youtube.com.
(Continued)

*Primary Examiner* — Phi D A

(74) *Attorney, Agent, or Firm* — Mederos Legal, PLLC; Diana Mederos

(57) ABSTRACT

A louvered enclosure system is provided that is capable of selectively fully or partially covering a designated area to block direct sunlight, rain, snow, etc. while allowing a selected amount of airflow to the designated area. The louvered enclosure system includes a pair of longitudinally extending rails having a plurality of movable louver assemblies extending between the rails. The movable louver assemblies are rotatable relative to the rails and longitudinally movable along the rails. A drive assembly rotates and moves the louver assemblies relative to the rails. The drive assembly includes separate rotation and drive mechanisms for selectively rotating the louver assemblies and moving the at least one movable louver assembly along the rails. Insulation may be provided on the louver assemblies to aid in insulating the designated space. The louver assemblies may be maintained rotated to a closed position by magnets securing each louver assembly to adjacent louver assemblies.

15 Claims, 13 Drawing Sheets

(51) Int. Cl.

| | |
|---|---|
| ***E04F 10/08*** | (2006.01) |
| *E04F 13/072* | (2006.01) |
| *E04F 13/08* | (2006.01) |

(56) References Cited

U.S. PATENT DOCUMENTS

| | | | | |
|---|---|---|---|---|
| 3,384,934 | A * | 5/1968 | Bush, Jr. | F16B 25/0005 24/356 |
| 4,099,346 | A | 7/1978 | Isono | |
| 4,375,183 | A | 3/1983 | Lynch | |
| 4,834,163 | A * | 5/1989 | Dickstein | E06B 9/362 160/176.1 R |
| 4,926,599 | A | 5/1990 | Scholz | |
| 5,357,712 | A | 10/1994 | Streeter | |
| 5,626,177 | A * | 5/1997 | Colson | E06B 9/262 160/168.1 V |
| 5,732,507 | A * | 3/1998 | Edwards | E06B 7/086 49/82.1 |
| 5,839,233 | A | 11/1998 | Smit | |
| 5,873,202 | A | 2/1999 | Parks | |
| 6,076,588 | A * | 6/2000 | Swiszcz | E06B 9/362 160/168.1 V |
| 6,105,656 | A * | 8/2000 | Hernandez | E06B 9/362 160/174 V |
| 6,314,680 | B1 | 11/2001 | Buckwalter et al. | |
| 7,335,096 | B2 | 2/2008 | Perez et al. | |
| 7,389,609 | B2 | 6/2008 | Yorgason | |
| 7,520,091 | B2 | 4/2009 | Friedman | |
| 7,559,174 | B2 | 7/2009 | Hoberman | |
| 7,958,926 | B2 | 6/2011 | Colson et al. | |
| 8,413,389 | B2 | 4/2013 | Frigerio | |
| 8,756,873 | B1 | 6/2014 | Hire | |
| 9,145,732 | B2 | 9/2015 | Frigerio | |
| 9,175,511 | B2 | 11/2015 | Whytlaw | |
| 9,422,715 | B1 | 8/2016 | Selzer | |
| 9,650,786 | B2 | 5/2017 | Weaver et al. | |
| 9,903,114 | B2 | 2/2018 | Partridge et al. | |
| 10,094,122 | B1 | 10/2018 | Akbulut | |
| 2002/0166643 | A1 * | 11/2002 | Anderson | E06B 9/36 160/177 V |
| 2009/0272037 | A1 | 11/2009 | Sosa | |
| 2012/0085030 | A1 * | 4/2012 | Marocco | E06B 7/096 49/82.1 |
| 2013/0056159 | A1 | 3/2013 | Gray | |
| 2013/0292066 | A1 | 11/2013 | Draper | |
| 2014/0130988 | A1 * | 5/2014 | Frigerio | E04B 7/166 160/161 |
| 2014/0175240 | A1 * | 6/2014 | Selzer | E04B 7/163 49/82.1 |
| 2017/0145689 | A1 | 5/2017 | Ivic | |
| 2017/0226746 | A1 | 8/2017 | Byszenski et al. | |
| 2020/0199929 | A1 * | 6/2020 | Tostee | E06B 7/096 |

FOREIGN PATENT DOCUMENTS

| | | | | |
|---|---|---|---|---|
| WO | WO-2016001739 | A1 * | 1/2016 | E04F 10/10 |
| WO | WO-2016059344 | A1 * | 4/2016 | E04B 7/163 |

OTHER PUBLICATIONS

"Slide Clear Oskura Retractable Louvered Roof System—Opening from Below" found at https://www.youtube.com.

* cited by examiner

LOUVERED ENCLOSURE SYSTEM

CROSS-REFERENCE TO RELATED APPLICATIONS

This application claims the benefit of U.S. Provisional Patent Application No. 62/936,989, filed on Nov. 18, 2019, which is incorporated by reference herein in its entirety.

FIELD OF THE INVENTION

The present invention relates generally to movable enclosure systems, and more particularly, to louvered enclosure system that is selectively extendable across a designated area to limit and control the amount of light, rain, wind, or other conditions reaching the designated area.

BACKGROUND OF THE INVENTION

When planning the architecture, landscaping or interior decoration of designated areas such as living spaces where people congregate, agricultural areas where plants are grown, etc., it is often desirable to control the amount of outside air and weather, in the forms of sun, rain, snow, etc., that reaches and enters the designated areas. People need to be able to control the comfort level inside the designated areas and growers need to control the amount of sun and rain reaching plants being grown in the designated areas.

Movable roofing systems have been developed to be extended out over designated areas such as those enumerated above. Many of these movable roofing systems include covers which can be fully or partially extended across the designated area to limit the amount of light or weather conditions reaching the designated areas. Unfortunately, in these systems, when even partially extended, a relatively large part of the designated area will be completely covered.

Other movable roofing systems may include movable louvers that can be pivoted or rotated so as to allow in a limited amount of weather while still blocking some of the weather. In these systems, the louvers rotate simultaneously with the extension of the louvers across the designated areas such that, when fully extended, the louvers either completely cover the designated area and block out the weather completely, or are oriented vertically allowing in a large amount of the weather. Thus, these systems are incapable of selectively controlling the amount of weather reaching the designated area.

Accordingly, there remains a need for a solution to at least one of the aforementioned problems. For example, there is a need for deployable roofing systems which allow for greater adjustability and customization of the effective covering provided by the system when totally or partially deployed.

SUMMARY OF THE INVENTION

The present invention is directed to a useful and multi-adjustable louvered enclosure system that is capable of selectively fully or partially covering a designated area to block direct sunlight, rain, snow, etc. while allowing a selected amount of air flow to the designated area. In different embodiments, the louvered enclosure system may be arranged horizontally, vertically, or in different orientations, depending on the specific application of the system. For instance, the louvered enclosure system may provide, a roof, a window or door covering (e.g., a storm shutter), a wall pane, or other applicable enclosure or barrier. The louvered enclosure system comprises a plurality of louvers that can be independently extended out across a designated area and can be separately rotated to control the amount of light or weather conditions reaching the designated area in a precise fashion. For example, in some embodiments, the louvered enclosure system includes a pair of longitudinally extending rails having a plurality of movable louver assemblies extending between the rails. The movable louver assemblies are rotatable relative to the rails and at least one of the movable louver assemblies is longitudinally movable along the length of the rails. A drive assembly is provided for rotating and moving the louver assemblies relative to the rails. The drive assembly includes separate rotation and drive mechanisms for selectively rotating the louver assemblies and moving the at least one movable louver assembly along the rails. A scissor mechanism is provided to carry the longitudinally movable louver assemblies along the length of the rails. Insulation may be provided on an underside of the louver assemblies to aid in insulating the designated space.

In a first implementation of the invention, a louvered enclosure system for selectively covering a designated area, comprises:

- a first longitudinally extending rail and a second longitudinally extending rail oriented parallel to said first longitudinally extending rail,
- a plurality of louver assemblies having at least a first louver assembly extending between said first and second longitudinally extending rails and a second louver assembly extending between said first and second longitudinally extending rails, the first and second louver assemblies being mounted for longitudinal movement along said first and second longitudinally extending rails, said first louver assembly including a first louver panel mounted on a first drive pin and said second louver assembly including a second louver panel mounted on a second drive pin;
- a drive assembly associated with said first and second louver assemblies for rotating said first and second louver assemblies relative to said first and second longitudinal rails and moving said first and second louver assemblies longitudinally along said first and second rails, said drive assembly including a drive mechanism having a longitudinally movable carriage connected to said second louver assembly and a rotatable lead screw in engagement with said movable carriage such that rotation of the lead screw drives the movable carriage longitudinally along said first and second longitudinally extending rails and a rotation mechanism including a first gear mechanism connected to said first drive pin, a second gear mechanism connected to said drive pin and a control shaft engageable with said first and second gear mechanisms such that rotation of said control shaft causes rotation of said first and second drive pins; and
- a scissor mechanism extending between said first and second louver assemblies.

In a second aspect, the scissor mechanism may be secured at one end to one of the first and second rails and secured at an opposite end to the carriage.

In another aspect, the carriage may be connected to the second drive pin of the second louver assembly.

In another aspect, the scissor mechanism may be secured to one of the first and second rails by an anchor screw.

In another aspect, the carriage can include a threaded surface engageable with threads on the lead screw.

In another aspect, the threaded surface of the carriage may be located in a semi-circular trough of the carriage.

In another aspect, the first gear mechanism can include a first gear housing, a first shaft gear connected to the control shaft and a first rotation gear connected to the first drive pin, the first shaft gear and the first rotation gear having inter engaging threads.

In another aspect, the first shaft gear may be slidable along the control shaft.

In another aspect, the first shaft gear may be mounted for rotation with the control shaft.

In another aspect, the first shaft gear can define a bore for receipt of the control shaft, the first shaft gear including an inwardly directed projection extending into the bore and the control shaft include a longitudinally extending slot for receipt of the inwardly directed projection of the first shaft gear.

In another aspect, the rotation mechanism can include a second gear mechanism connected to the second drive pin and the carriage.

In another aspect, the first and second louver assemblies are magnetically attachable to one another to maintain the first and second louver assemblies in a closed position in which the first and second assemblies have rotatably adopted a generally coplanar position relative to one another.

In another aspect, the first and second louver assemblies can be magnetically attachable by having at least one of the first and second louver assemblies made of a ferromagnetic material and the other of the first and second louver assemblies comprise one or more magnets configured to magnetically attach to the ferromagnetic material.

In another aspect, the first and second louver assemblies can both be provided with one or more respective magnets configured to attract to each other.

In another aspect, the one or more respective magnets can be arranged along opposed edges of the first and second louver assemblies.

In another aspect, the louvered roof assembly can further include insulation provided on the plurality of louver assemblies.

In another implementation of the invention, a louvered enclosure system for selectively covering a designated area comprises:

a structure;

a plurality of louver assemblies rotatably carried by the structure, the plurality of louver assemblies configured to adopt a closed position in which the louver assemblies are rotated to a generally coplanar position relative to one another;

at least one magnetic attachment configured to fix each louver to an adjacent louver and maintain the louvers in the closed position.

In a second aspect, the structure may include a first longitudinally extending rail and a second longitudinally extending rail oriented parallel to the first longitudinally extending rail. The plurality of louver assemblies can be rotatably carried by the first and second longitudinally extending rails.

In another implementation, a louvered enclosure system for selectively covering a designated area comprises a first rail and a second rail, the rails extending along a longitudinal direction and in parallel relationship with one another. A plurality of louver assemblies extends between the first and second rails in a transverse direction perpendicular to the longitudinal direction. The louver assemblies are mounted for longitudinal movement along the first and second longitudinally extending rails. The louvered enclosure system further includes an expandable and contractable drive assembly connected to the plurality of louver assemblies and configured to cause forward and rearward longitudinal movement of the plurality of louver assemblies along the first and second rails. A longitudinal separation between the louver assemblies is adjustable responsively to expansion and contraction of the drive assembly. Furthermore, each louver assembly is rotatably connected to the drive assembly such that the louver assembly is rotatable relative to the first and second rails about a respective rotation axis arranged in the transverse direction.

In a second aspect, the louvered enclosure system may further include an insulation material provided on the plurality of louver assemblies.

In another aspect, the plurality of louver assemblies may be configured to adopt a rotationally closed position in which the louver assemblies are generally coplanar and contiguous relative to one another. In the rotationally closed position, each two adjacent louver assemblies may be secured to one another by at least one fastener.

In another aspect, the fastener(s) may include a hook.

In another aspect, each louver assembly of the plurality of louver assemblies may include an elongate louver panel and an elongate side panel forming an L-shaped arrangement. One louver assembly of each two adjacent louver assemblies may include the hook. In turn, the side panel of the other louver assembly of each two adjacent louver assemblies may be configured to engage with the hook when the plurality of louver assemblies is arranged in the rotationally closed position.

In yet another aspect, the fastener(s) may include a magnet.

In another aspect, each two adjacent louver assemblies may be secured to one another along a watertight junction provided by the at least one fastener.

In another aspect, the watertight junction may extend from the first rail to the second rail.

In another aspect, the drive assembly may include a scissor mechanism. An end of each louver assembly of the plurality of louver assemblies may be carried by the scissor mechanism and may be pivotable relative to the scissor mechanism.

In yet another aspect, the scissor mechanism may be arranged within one of the first and second rails.

In another aspect, a first end of the scissor mechanism may be secured to said one of the first and second rails such that the first end of the scissor mechanism is not longitudinally movable along the one of the first and second rails as the scissor mechanism expands or contracts.

In another aspect, the drive assembly may further include a longitudinally movable carriage attached to the scissor mechanism, and a rotatable lead screw in threaded engagement with the carriage, such that rotation of the lead screw selectively drives the carriage longitudinally frontward or rearward to expand or contract the scissor mechanism, respectively.

In another aspect, the carriage may be connected to a specific louver assembly of the plurality of louver assemblies arranged frontward of other louver assemblies of the plurality of louver assemblies.

In another aspect, the drive assembly may further include a plurality of worm gears attached to the scissor mechanism, the plurality of worm gears comprising a respective worm gear associated to each louver assembly of the plurality of louver assembles. Each louver assembly associated to the respective worm gear may be rotatably carried by the respective worm gear. The drive assembly may additionally include a control shaft engaged with the plurality of worm gears such that the worm gears is slidable along the control shaft and is jointly rotatably with the control shaft about a central longitudinal axis of the control shaft. Rotation of the control shaft about the central longitudinal axis of the control shaft may be converted to a rotation of each louver assembly by the respective worm gear.

In yet another aspect, the control shaft may include a longitudinally extending slot configured to longitudinally slidably receive a radially inwardly directed projection formed in each worm gear.

In another aspect, each louver assembly of the plurality of louver assemblies may include a respective pin at an end of the louver assembly. The pin may be formed along the transverse direction and may be engaged with the respective worm gear of each louver assembly such that rotation of the respective pin by the respective worm gear drives the louver assembly to rotate.

In another aspect, the carriage may be attached to a specific louver assembly of the plurality of louver assemblies arranged frontward of other louver assemblies of the plurality of louver assemblies, and may be further attached to the respective worm gear associated to the specific louver assembly.

In yet another aspect, the respective worm gear of the specific front louver assembly and the carriage may be connected to the pin of the specific front louver assembly.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a louvered enclosure system that is capable fully or partially covering a designated area such as, but not limited to, a living or recreating area, a growing area, a door, a window, etc.

Figure 1:
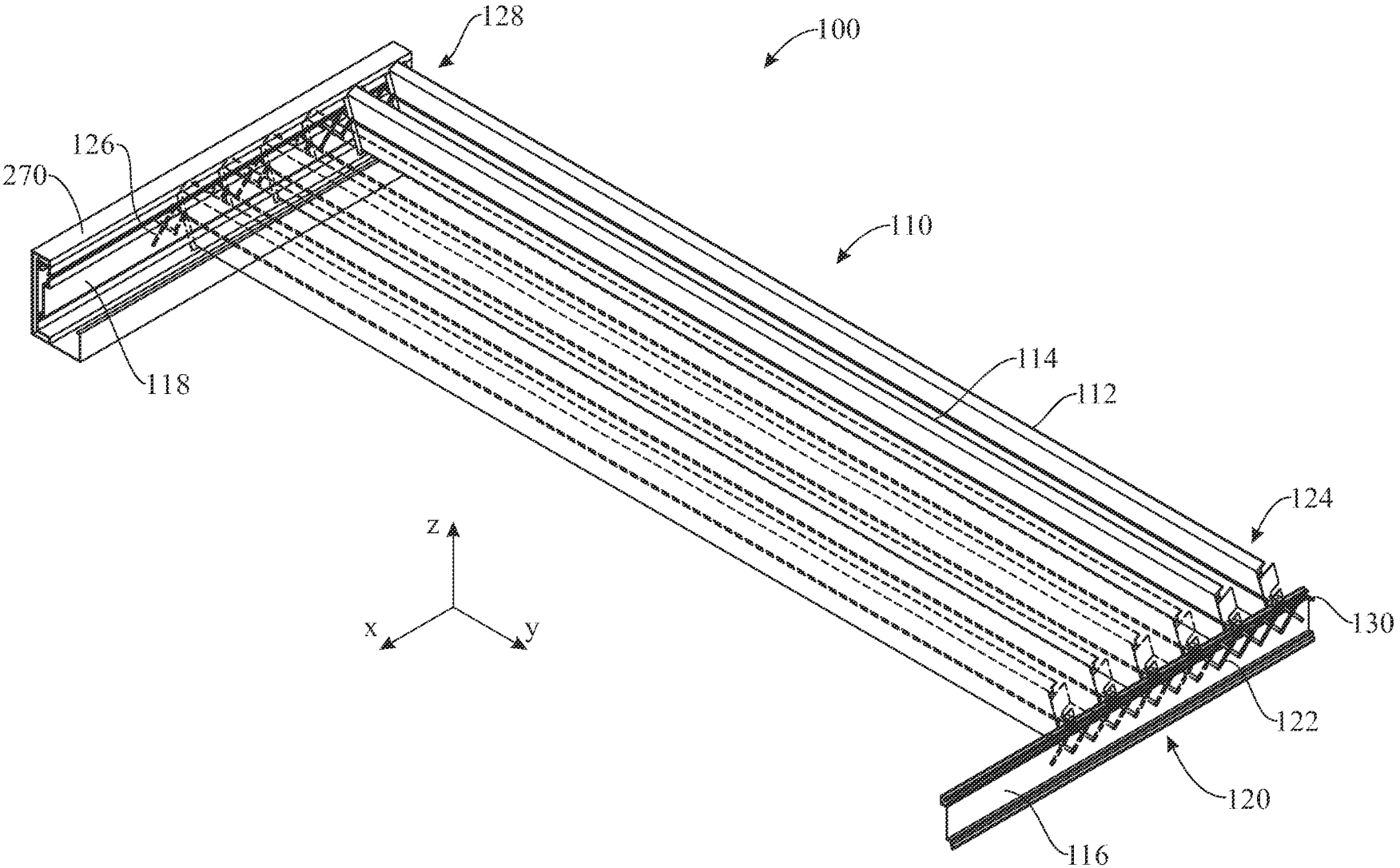
FIG. 1 presents a top, front isometric view, partially shown in phantom, illustrating a louvered enclosure system in accordance with a first embodiment of the present invention.
Figure 2:
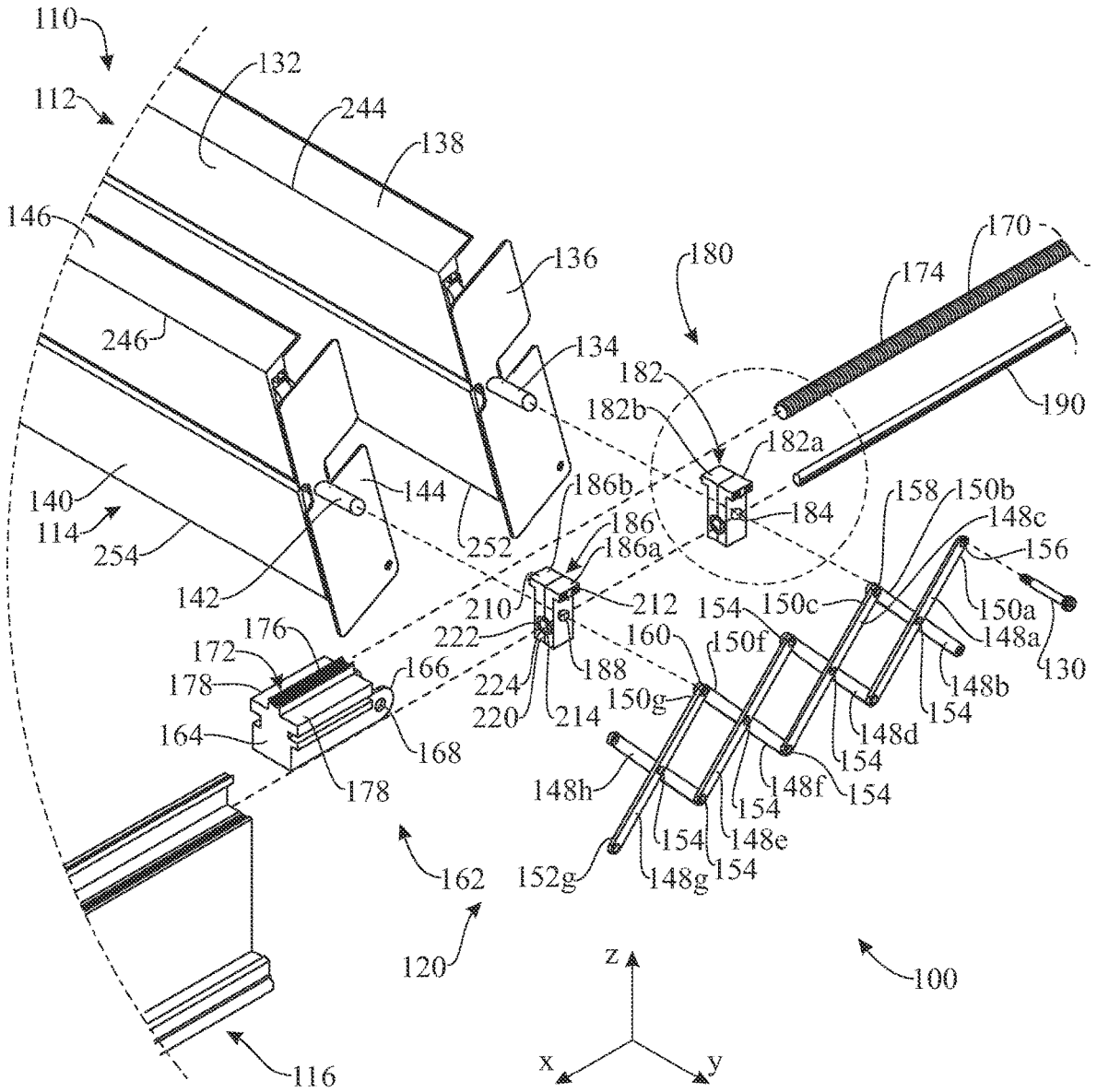
FIG. 2 presents a partial top, front isometric view of the louvered enclosure system of FIG. 1 with parts separated.
Figure 3:
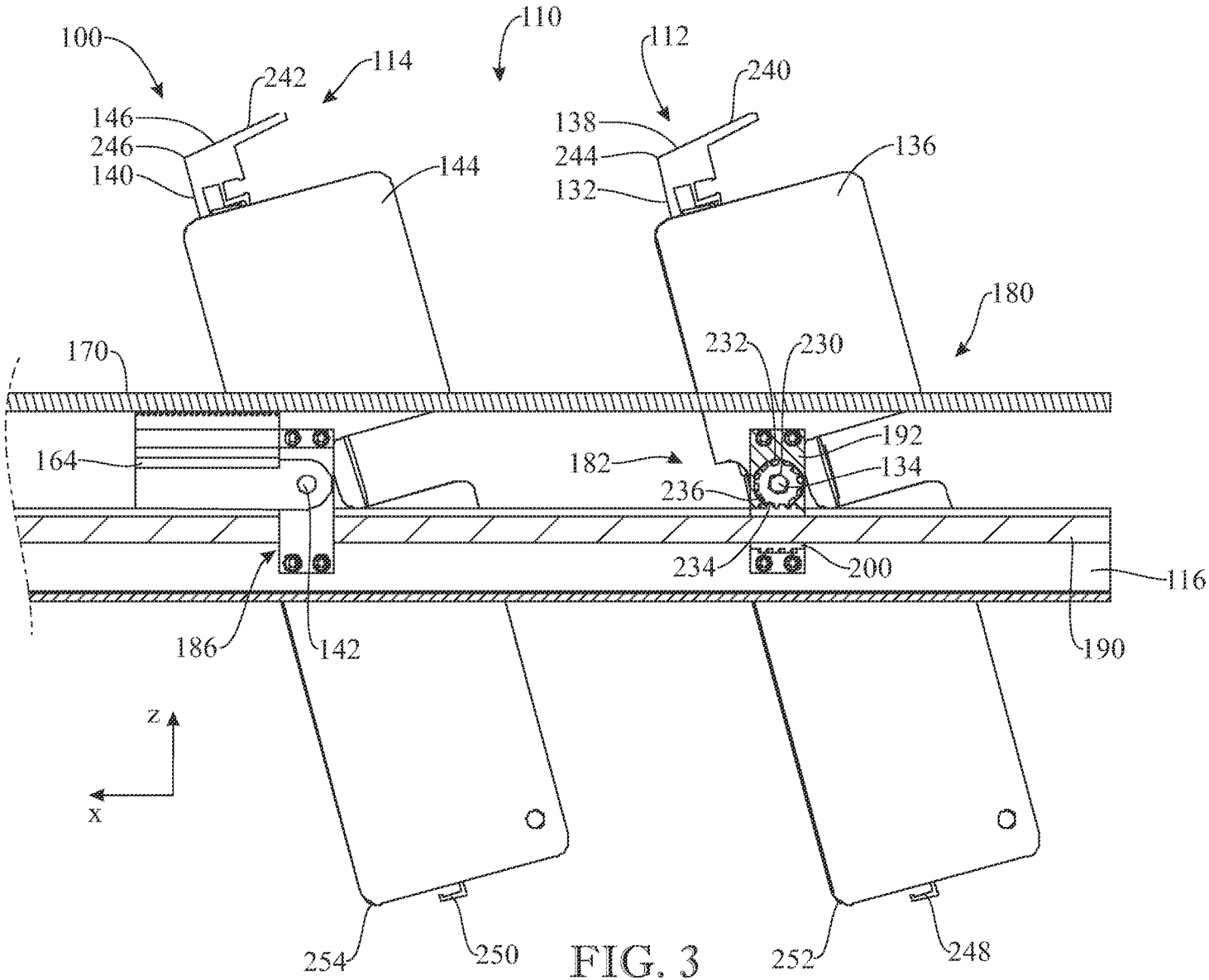
FIG. 3 presents a side elevation view, partially shown in section, of the louvered enclosure system of FIG. 1.

Referring to FIGS. 1-3, and initially with regard to FIG. 1, a louvered enclosure system 100 is illustrated in accordance with an exemplary embodiment of the present invention, wherein the louvered enclosure system 100 is configured as an extendable and retractable roof. As shown, the louvered enclosure system 100 generally includes a plurality of louver assemblies 110 including, but not limited to, a first louver assembly 112 and a second louver assembly 114. The louver assemblies 110 are assembled between and ride along a first rail 116 and a second rail 118, which are arranged in spaced-apart relationship with one another, as shown. The louver assemblies 110 are displaceable along a longitudinal direction x (i.e. longitudinally displaceable) along the first and second rails 116 and 118. A drive assembly 120 is connected to the louver assemblies 110 and operates to both extend and retract the plurality of louver assemblies 110 longitudinally along the first and second rails 116 and 118, respectively, as well as rotate the louver assemblies 110 relative to the first and second rails 116 and 118 as described in more detail hereinbelow. It should be noted that, while the following discussion is with regard to the first and second louver assemblies 112 and 114, respectively, the louvered enclosure system 100 contains a sufficient number of additional louver assemblies (shown in phantom) mounted on the first and second rails 116 and 118, and connected to the drive assembly 120, to cover the designated and desired space. The first and second rails 116 and 118 are elongately formed along the longitudinal direction x, longitudinally extend across the designated space, and are parallel to each other.

With reference to FIG. 1, in order to longitudinally displace (i.e., extend and retract) the louver assemblies 110 longitudinally along the first and second rails 116 an-d 118, the drive assembly 120 includes a first scissor mechanism 122 connected to a first end 124 of the louver assemblies 110 and a second scissor mechanism 126 connected to a second end 128 of the louver assemblies 110. The first and second scissor mechanisms 122 and 126 are connected to the louver assemblies 110, for example to the first louver assembly 112 and the second louver assembly 114, and carry the louver assemblies 110 along the first and second rails 116 and 118. The first and second scissor mechanisms 122 and 126 maintain a proper and consistent spacing between the louver assemblies 110 as the louver assemblies are extended, retracted, and rotated relative to the first and second rails 116 and 118. Anchor screws 130 are connected to the first and second scissor mechanisms 122 and 126 and are provided to anchor one respective-end of the first and second scissor mechanisms 122 and 126 in place relative to the first and second rails 116 and 118.

Referring now to FIG. 2, the first louver assembly 112 includes an elongate, first louver blade or panel 132 connected to the first scissor mechanism 122 by a first drive pin 134. As shown, the first louver panel 132 and first drive pin 134 may extend along a transverse direction y which is generally perpendicular to the longitudinal direction x. It should be noted that, while the following discussion of the louver assemblies 110 and drive mechanism 120 is given with regard to the first end 124 of the louver assemblies 110, the second end 128 of the louver assemblies 110 may be constructed similarly and may be provided with a similar drive mechanism (not shown) to provide equal displacement and rotation forces on both the first and second ends 124 and 128 of the louver assemblies 110. The first louver assembly 112 additionally includes a first end plate 136 and a first side panel 138. The first side panel 138 is elongate and extends from the first louver panel 132 along the transverse direction y, forming an angle or L-shaped arrangement with the first louver panel 132. In turn, the first end plate 136 is arranged at or near an end of the first louver panel 132 and first side panel 138, as shown.

Likewise, the second louver assembly 114 includes an elongate, second louver panel 140 connected to the first scissor mechanism 122 by a second drive pin 142. Similarly to the first louver panel 132, the second louver panel 140 and second drive pin 142 extend along the transverse direction y. The second louver assembly 114 additionally includes a second end plate 144 and a second longitudinally extending second side panel 146. The second side panel 146 is elongate and extends from the second louver panel 140 along the transverse direction y, forming an angle or L-shaped arrangement with the second louver panel 140. In turn, the second end plate 144 is arranged at or near an end of the second louver panel 140 and second side panel 146, as shown.

In summary, each louver assembly of the plurality of louver assemblies 110 includes an elongate louver blade or panel (e.g., panels 132 and 140) and may include an elongate side panel (e.g., side panels 138 and 146) extending at an angle or L-shape formation with the elongate louver panel, and/or an end panel (e.g., end panels 136 and 144).

As further shown in FIG. 2, the first scissor mechanism 122 generally includes a plurality of scissor bars 148 having top ends 150 and bottom ends 152. The scissor bars 148 are connected together by pivot pins 154 located centrally in the scissor bars 148 and at the top and bottom ends 150 and 152, respectively. The pivot pins 154 permit adjacent scissor bars 148 to rotate relative to each other as the first scissor mechanism 122 is displaced along the first rail 116. The number of scissor bars 148 provided in the first scissor mechanism 122 may depend on the total number of louver assemblies 110. For example, while the first scissor mechanism 122 is illustrated as having scissor bars **148*a*-148*h*, more scissor bars 148 would be provided for a longer set of louver assemblies 110. The first scissor mechanism 122 includes a hole 156 in the top end 150*a* of a first scissor bar 148*a* of the first scissor mechanism 122 for receipt of the anchor screw 130 that prevents translation of the top end 150*a* relative to and along the first rail 116. Similarly, the first scissor mechanism 122 includes holes 158 and 160 in the top ends 150*b*, 150*c* and 150*f*, 150*g* of the scissor bars 148*b*, 148*c*, and 148*f*, 148*g*, respectively, for receipt of and connection with the first and second drive pins 134 and 142 of the first and second louver assemblies 112 and 114**, respectively.

With continued reference to FIG. 2, in order to move or displace the first and second louver assemblies 112 and 114 longitudinally along the first and second rails 116 and 118, the drive assembly 120 includes a drive mechanism 162 including a carriage 164 and a lead screw 170. The carriage 164 comprises a mounting projection 166 with at least one mounting hole 168 for connection to the first scissor mechanism 122. The lead screw 170 is engageable with the carriage 164 for moving the carriage 164 longitudinally relative to the first and second rails 116 and 118. In some embodiments, the carriage 164 can be connected to the louver assembly of the plurality of louver assemblies 110 which is at an end of the first second mechanism 122 opposite to the anchor screw 130; however, for clarity purposes, the carriage 164 will be shown, and described, as connected to the second louver assembly 114, and operation of the complete plurality of louver assemblies 110 will be described as if the plurality of louver assemblies 110 were comprised only of the first louver assembly 112 and second louver assembly 114.

Thus, as shown in FIG. 2, the carriage 164 is connected to the first scissor mechanism 122 by the second drive pin 142 of the second louver assembly 114. Again, it should be noted that, in actual assembly and practice, the carriage 164 may be connected to the last drive pin of the last louver assembly of the set of louver assemblies 110 to facilitate pulling the entire set of louver assemblies 110 along the first and second rails 116 and 118.

The carriage 164 is provided with a longitudinally extending, semi-circular trough 172 for receipt of, and engagement with, the lead screw 170. The lead screw 170 is provided with threads 174 which engage a threaded inner surface 176 in the trough 172 of the carriage 164. The lead screw 170 is configured to rotate about a central longitudinal axis of the lead screw 170 while remaining longitudinally fixed relative to the first rail 116, such that rotation of the longitudinally-fixed lead screw 170 causes the carriage 164 to translate or displace longitudinally along the first rail 116. The carriage 164 can be generally T-shaped in cross section and may include one or more projections 178 configured to ride along the first rail 116. The carriage 164 is preferably free to move or float along the first rail 116.

Referring now to FIGS. 2 and 3, it should be noted that the drive mechanism 162 moves the louver assemblies 100 longitudinally along the first and second rails 116 and 118. However, in order to rotate or open and close the louver assemblies 100, the drive assembly 120 additionally includes a rotation mechanism 180 connected to the first and second drive pins 134 and 142 of the first and second louver assemblies 112 and 114, respectively. The rotation mechanism 180 includes a respective gear mechanism for connection to each of the louver assemblies 110; specifically, in the depicted example, the rotation mechanism 180 includes a first gear mechanism 182, having a transverse, first through bore 184, for connection to the first louver assembly 112, and a second gear mechanism 184, having a transverse, second through bore 188, for connection to the second louver assembly 114. The first and second gear mechanisms 182 and 186 can be "T-shaped" having respective wings 182*a* and 182*b*, and 186*a* and 186*b*, respectively, which may ride freely or float over the first rail 116.

The first drive pin 134 is rotationally positioned within the first through bore 184 of the first gear mechanism 182 and the second drive pin 142 is rotationally positioned within the second through bore 188 of the second gear mechanism 186. The positioning of the first and second drive pins 134 and 142 within the first and second gear mechanism 182 and 186 a respective (transverse) rotation axis for each corresponding louver assembly 112 and 114 and also keeps the first and second gear mechanisms on the first rail 116. The rotation mechanism additionally includes a control shaft 190 connected to the first and second gear mechanisms 182 and 184 to rotate the first and second louver assemblies 112 and 114 via their respective drive pins 134 and 144 as described hereinbelow. The first and second gear mechanisms 182 and 184 are free to slide along the length of the control shaft 190 as the louver assemblies 110 are extended and retracted along the length of the first and second rails 116 and 118 by the first and second scissor mechanisms 122 and 126.

Figure 2A:
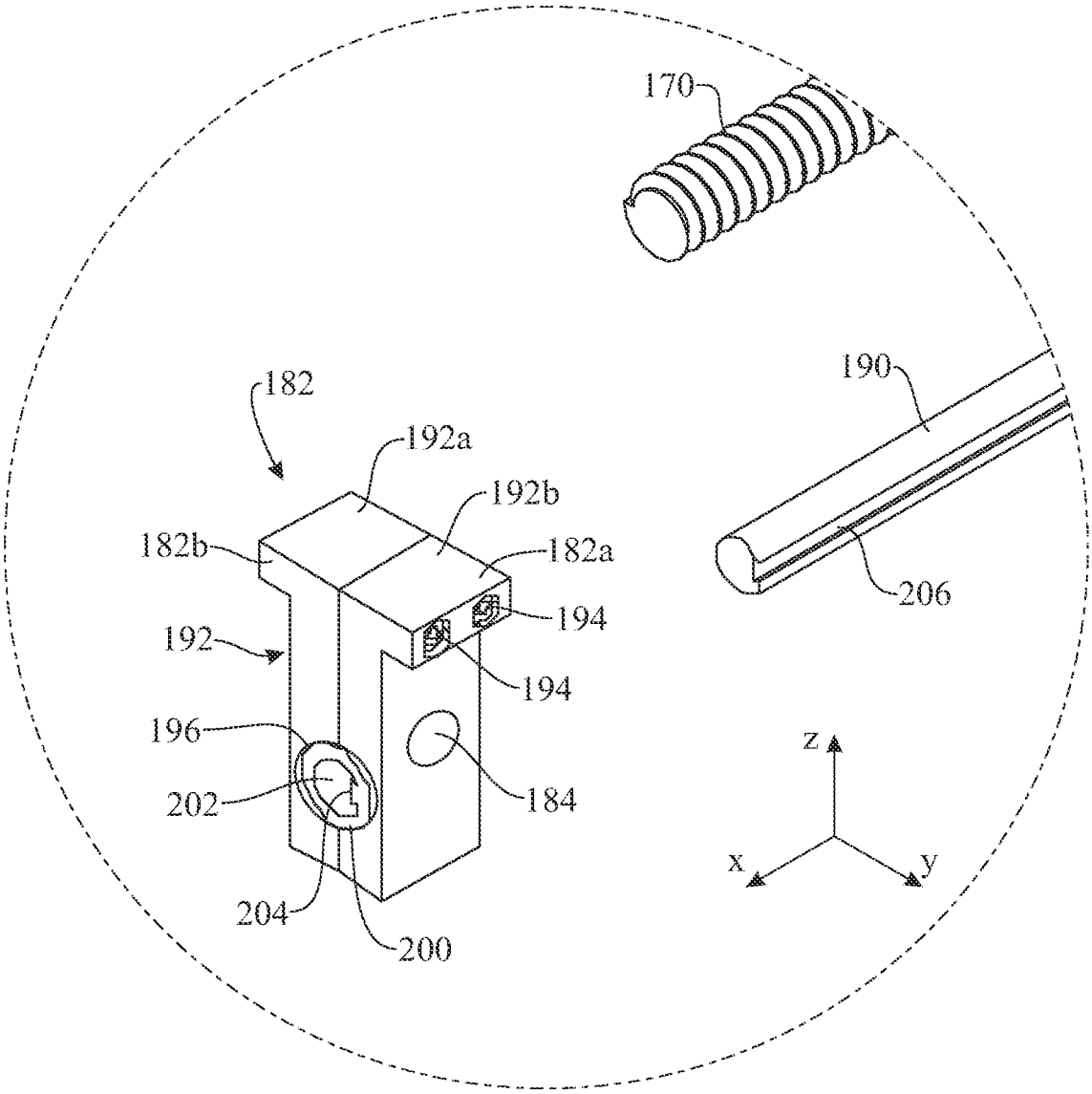
FIG. 2A presents an enlarged area of detail view of FIG. 2, illustrating a rotation mechanism of the louvered enclosure system of the FIG. 1.

Referring for the moment to FIG. 2A, the first gear mechanism 182 includes a first gear housing 192 split into gear housing halves 192*a* and 192*b* that are held together by screws 194 or other known fasteners. Each gear housing half 192*a* and 192*b* may be generally L-shaped, as shown. The first gear housing 192 defines a longitudinally oriented bore or cavity 196. The first gear mechanism 182 further includes a first shaft gear 200 rotatably contained and retained within the cavity 196. The first shaft gear 200 defines a bore 202 for slidable receipt of the control shaft 190. A radially-inwardly directed projection 204 on the first shaft gear 200 slidably and non-rotationally engages a longitudinal slot 206 in the control shaft 190, such that the inwardly-directed projection 204 is slidable along the longitudinal slot 206 while non-rotationally locking the first shaft gear 200 to the control shaft 190. I.e., the control shaft 190 and first shaft gear 200 are jointly rotatable about a central longitudinal axis of the control shaft 190, and yet the first shaft gear 200 is longitudinally displaceable along the control shaft 190. Rotation of the control shaft 190 about the central longitudinal axis of the control shaft 190 causes the first shaft gear 200 to rotate within the first gear housing 192.

Referring back to FIG. 2, the second gear mechanism 186 similarly includes a second gear housing 210, split into housing halves 210*a* and 210*b* that are held together by screws 212. The second gear housing 210 defines a cavity 214 similar to cavity 196 above. The second gear mechanism 186 also includes a second shaft gear 220 rotatably contained and retained within the cavity 214 and slidably and non-rotationally mounted on the control shaft 190. The second shaft gear 220 also includes and inwardly directed projection 224 engageable within the slot 206 in the control shaft 190. The control shaft 190 and second shaft gear 220 are jointly rotatable about the central longitudinal axis of the control shaft 190, while the second shaft gear 220 is longitudinally displaceable along the control shaft 190. Rotation of the control shaft 190 rotates the second shaft gear 220 within the second gear housing 210.

Referring specifically to FIG. 3, the first rotation mechanism 182 additionally includes a first rotation gear 230 located within a rotation cavity 232 defined within the first gear housing 192. The first rotation gear 230 is non-rotationally attached to the first drive pin 134 of the first louver assembly 112 such that rotation of the first rotation gear 230 rotates the first drive pin 134 about its central axis and thus rotates the first louver assembly 112 relative to the first and second rails 116 and 118 about a rotation axis arranged in the transverse direction y.

The first shaft gear 200 is provided with teeth 234 which engage a thread 236 provided on the first rotation gear 230 preferably in worm gear like fashion. Thus, rotation of the control shaft 190 along its central longitudinal axis causes the first shaft gear 200 to rotate jointly with the control shaft 190, which in turn causes the first rotation gear 230 to rotate about a transverse rotation axis (which is perpendicular to the rotation axis of the first shaft gear 200). As noted above, rotation of the first rotation gear 230 rotates the first louver assembly 112 through the first drive pin 134. While not specifically shown, the second gear mechanism 186 also includes an identical rotation gear within a rotation cavity and includes teeth engageable with teeth on the second shaft gear to rotate the second louver assembly 114 in response to rotation of the control shaft 190.

The additional louver assemblies (not shown) are similarly constructed to translate and rotate relative to the first and second rails 116 and 118. Additionally, the second ends 128 of the louver assemblies 110 may include similar drive mechanisms and rotation mechanisms, identical to the drive mechanism 162 and the rotation mechanism 180 described herein, to translate and rotate the louver assemblies 110 from both the first and second ends 124 and 128, respectively, of the louver assemblies 110.

With continued reference to FIG. 3, it can be seen that the longitudinally extending first and second side panels 138 and 146 of the first and second louver assemblies 112 and 114, respectively, include downwardly depending edges 240 and 242. The first and second side panels 138 and 146 extend from first edges 244 and 246 (see also FIG. 2) of the first and second louver panels 132 and 140. In turn, first and second hooks 248 and 250 are provided at or near second edges 252 and 254 of the first and second louver panels 132 and 140 (the second edges 252 and 254 opposite to the first edges 244 and 246, respectively) such that when the first and second louver assemblies 112 and 114 are rotated to a closed condition the first and second downwardly depending edges engage the first and second hooks of the next adjacent louver assembly to prevent over rotation of the first and second louver assemblies 112 and 114 and lock them together in the closed condition. For example, rotation of the first and second louver assemblies 112 and 114 causes the downwardly depending edge 242 of the second side panel 146 of the second louver assembly 114 to engage the hook 248 extending carried by the first louver panel 132 of the first louver assembly 112. In some embodiments, each hook 248, 250 may be elongately formed along the transverse direction y, preferably along a full length of the louver assemblies 110 or spacing between the of the first and second rails 116 and 118. The engagement of the second downwardly depending edge 242 with the first hook 248 may help form a watertight seal to prevent leaks through the louvered enclosure system when deployed and rotated to the closed condition.

Figure 4:
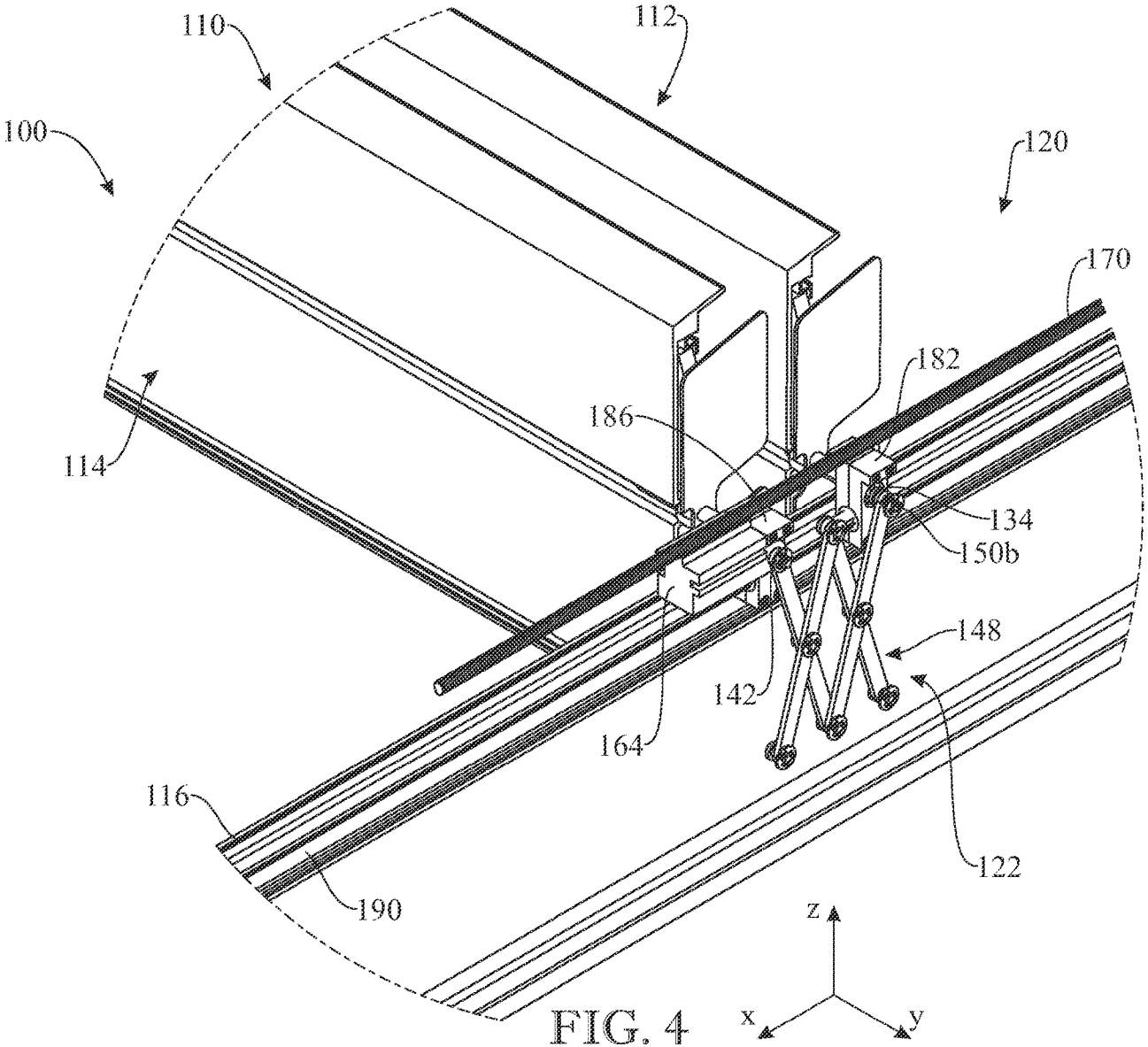
FIG. 4 presents a top, front isometric view of the louvered enclosure system of FIG. 1, illustrating louver assemblies and a drive assembly of the louvered enclosure system for moving the louver assemblies, the drive mechanism shown in a contracted condition.
Figure 5:
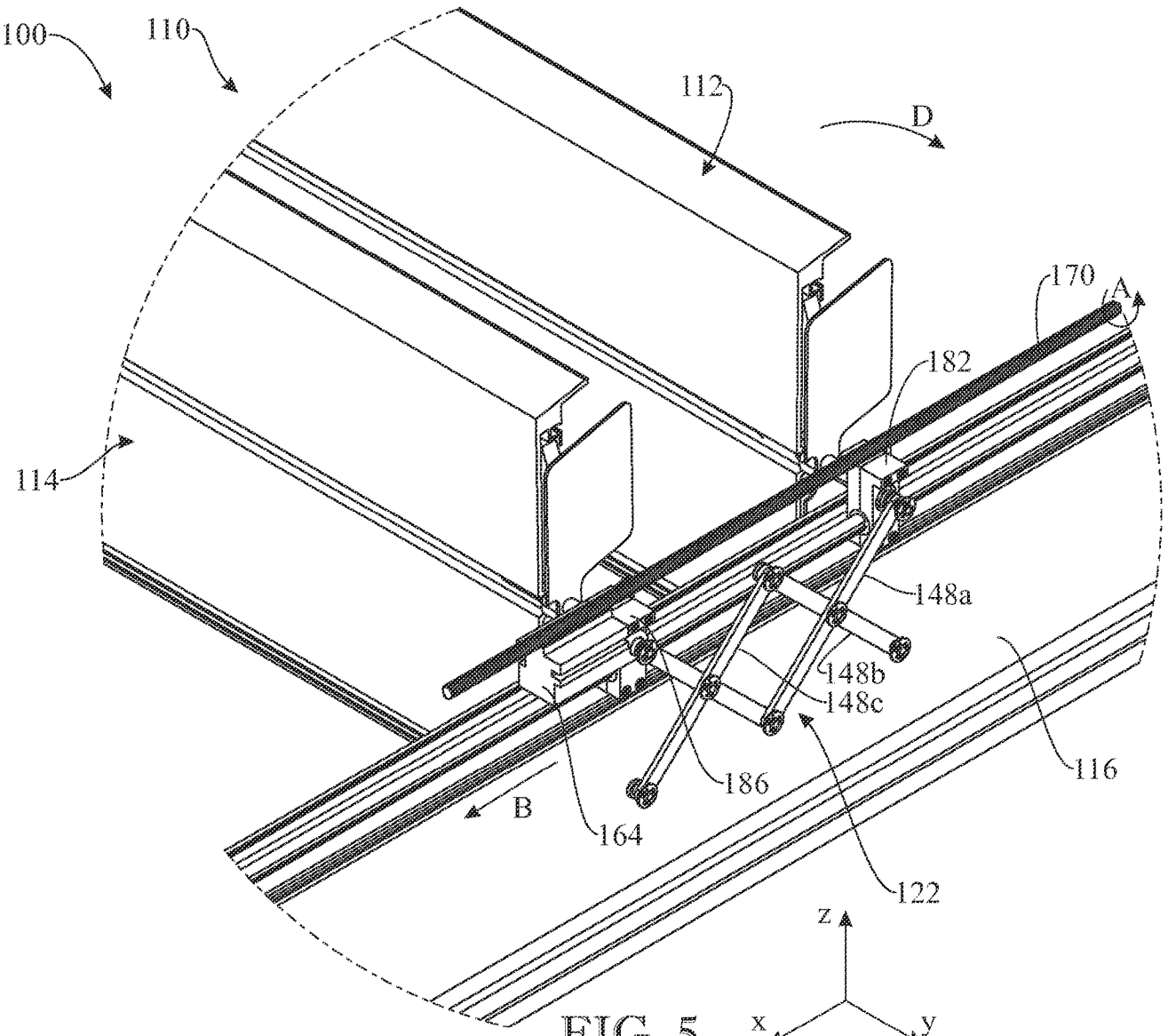
FIG. 5 presents a top, front isometric view of the louvered enclosure system of FIG. 1, similar to FIG. 4, illustrating initial extension of a drive mechanism of the drive assembly to partially separate the louver assemblies.
Figure 6:
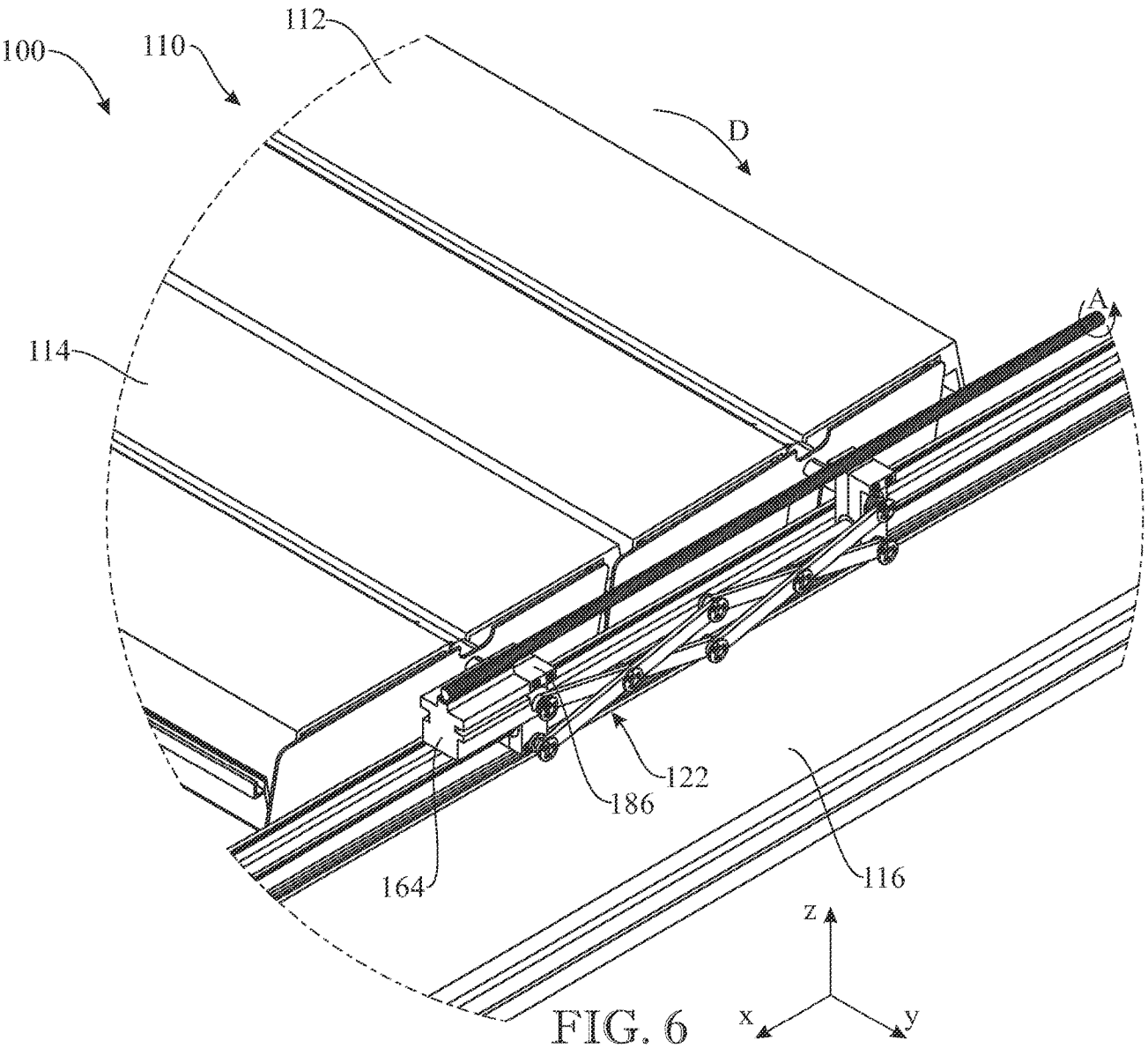
FIG. 6 presents top, front isometric view of the louvered enclosure system of FIG. 1, similar to FIG. 5, illustrating full extension of the drive mechanism and with the louver assemblies rotated to a closed condition.

Turning now to FIGS. 4-6, and initially with regard to FIG. 4, the operation of the drive assembly 120 to longitudinally move the louver assemblies 110 along the first and second rails and rotate the louver assemblies 110 from an open condition to closed condition will now be described. While not specifically shown, the drive assembly 120 may include various devices to rotate both the lead screw 170 and the control rod 190. For example, the drive assembly 120 may include manually operable controls such as, but not limited to, cranks, levers, wheels, etc. or may include automated controls having motors and switches to rotate the lead screw 170 and the control rod 190. Programmable systems, such as computers, on board control modules, etc., may be provided to actuate the automated controls in response to predetermined inputs, such as, but not limited to, time of day, duration of extension and retraction, angle of rotation, etc.

In an initial condition, the first and second louver assemblies 112 and 114 are in a vertical condition as shown in FIG. 4, and are fully retracted relative to the first rail 116. As noted above, the anchor screw 130 (FIGS. 1 and 2) holds one end of the scissor mechanism 122 in a fixed longitudinal position relative to the first rail 116. The first scissor mechanism 122 is also in a first retracted or contracted condition. The lead screw 170 and the control rod 190 are initially stationary.

Referring to FIG. 5, in order to extend the first and second louver assemblies 112 and 114, along with any other louver assemblies 110, to an expanded or extended condition, the drive assembly 120 is activated to rotate the lead screw 170 in the direction of arrow "A". Rotation of the lead screw 170 drives the carriage 164 longitudinally along the first rail 116 in the direction of arrow "B" to extend the louver assemblies 110 out along the first and second rails 116 and 118, respectively. Specifically, the carriage 164 is connected to the second gear mechanism 186 (FIGS. 2 and 3) which in turn is connected to the second drive pin 142 of the second louver assembly 114. As the carriage 164 moves longitudinally away from the fixed anchor screw 130, the first scissor mechanism 122 is opened from the contracted condition to a partially expanded condition carrying the first and second louver assemblies 112 and along the first and second rails 116 and 118. Thus, as shown, the first louver assembly 112 and the second louver assembly 114 are moved from the initial retracted or contracted condition to a partially extended or expanded condition while still remaining vertically oriented.

It should be noted that the first scissor mechanism 122 (as well as the second scissor mechanism 126, which is shown in FIG. 1) may be constrained within a cavity in the rails and the pins 154 may be formed of a low friction plastic, which, in some embodiments, may help prevent the first and second scissor mechanisms 122 and 126 from twisting as they extend and retract.

Turning to FIG. 6, continued operation of the drive assembly 120 to rotate the lead screw 170 may moves the carriage 164 to a furthermost point away from the anchor screw 130. In this farthest position of the carriage 164, the first scissor mechanism 122 may be arranged in a further, optionally fully extended condition pulling the louver assemblies 110, including the first and second louver assemblies 112 and 114, to a furthermost position relative to the anchor screw 130 and to a fully extended condition.

In partially or fully extended positions of the scissor mechanisms 122 and 126, the drive assembly 120 may be operated to rotate the first and second louver assemblies 112 and 114. For example, in the operation sequence depicted herein, once the first and second louver assemblies 112 and 114 have been expanded to the fully extended position, the drive assembly 120 is subsequently operated to rotate the first and second louver assemblies 112 and 114 from the vertical or open condition (FIGS. 4 and 5) to a horizontal or closed condition. More specifically, the drive assembly 120 is operated to rotate the control rod 190 of the rotation mechanism 180. The rotation of the control rod 190 in the direction of arrow "C" causes the rotation of the first and second drive pins 134 and 142 through operation of the first and second gear mechanisms 182 and 186 as described hereinabove. The rotation of the first and second drive pins 134 and 142 rotates the first and second louver assemblies 112 and 114 about respective transverse rotation axes defined by the first and second drive pins 134 and 143, as indicated by arrow "D", from the open or vertical condition (FIG. 5) down to a horizontal or closed condition as shown.

Thus, in this manner, the drive assembly 120 operates to extend and/or rotate the various louver assemblies 110 in the louvered enclosure system 100.

Figure 7:
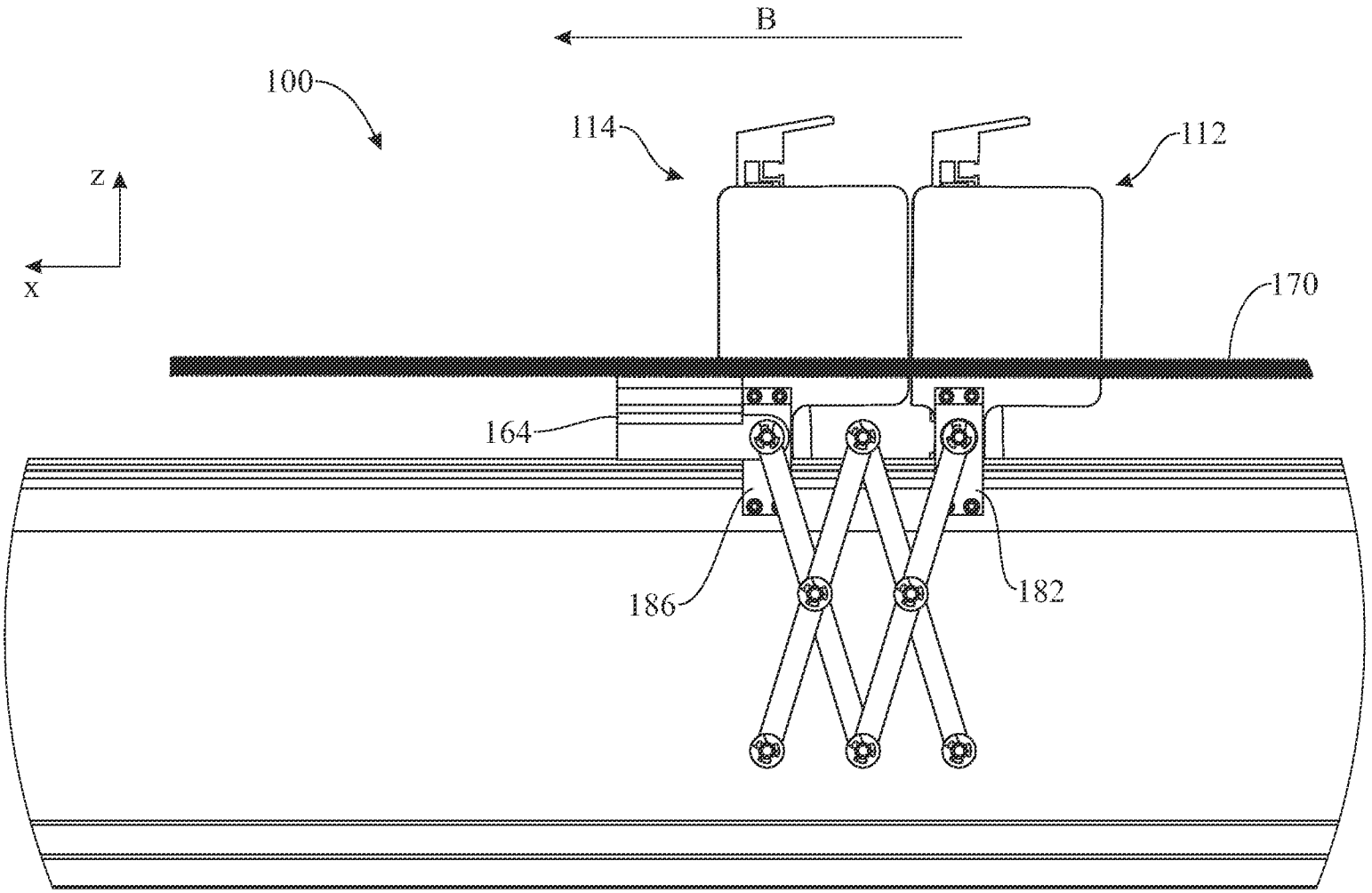
FIG. 7 presents a side elevation view of the louvered enclosure system of FIG. 4.
Figure 8:
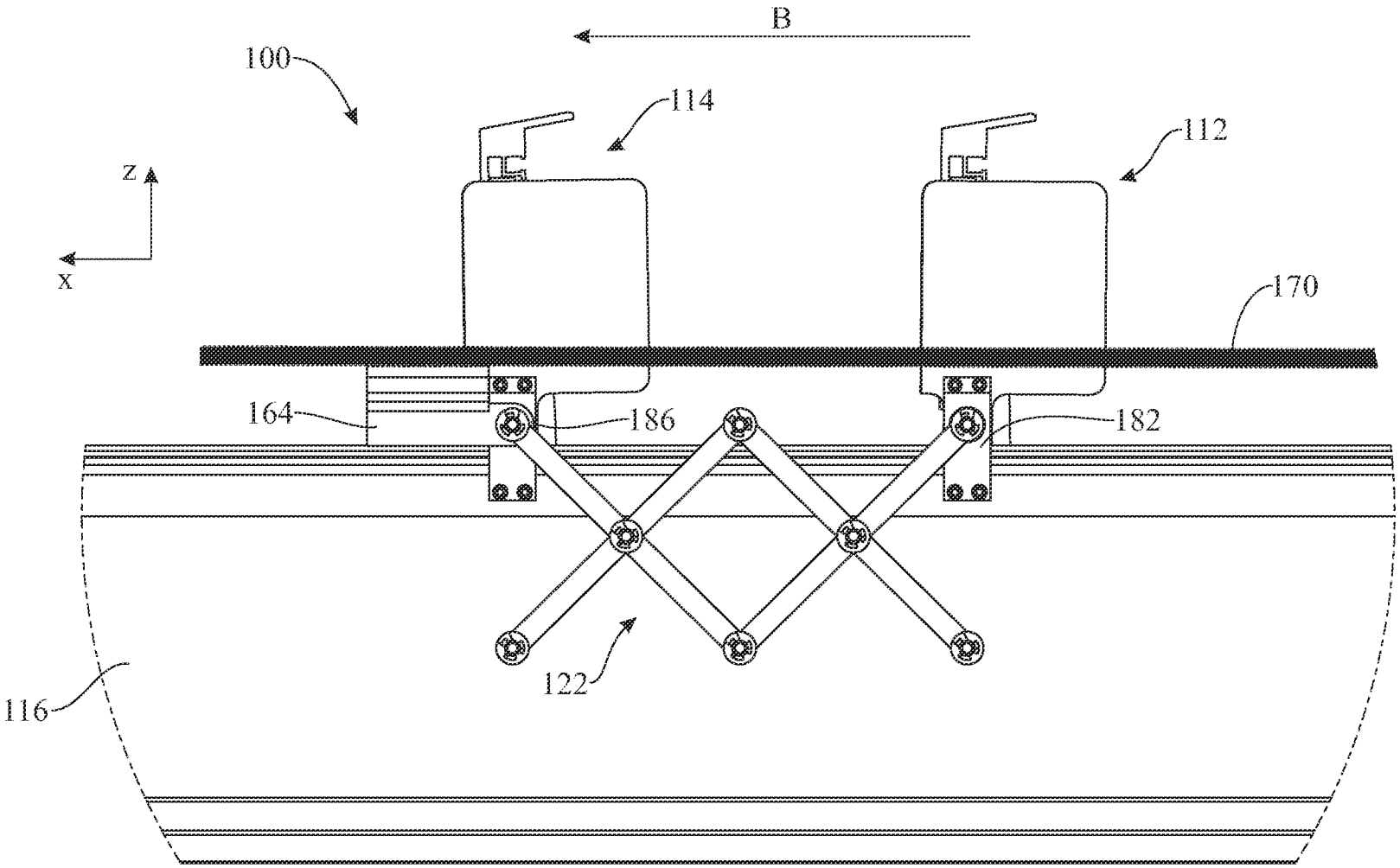
FIG. 8 presents a side elevation view of the louvered enclosure system of FIG. 5.
Figure 9:
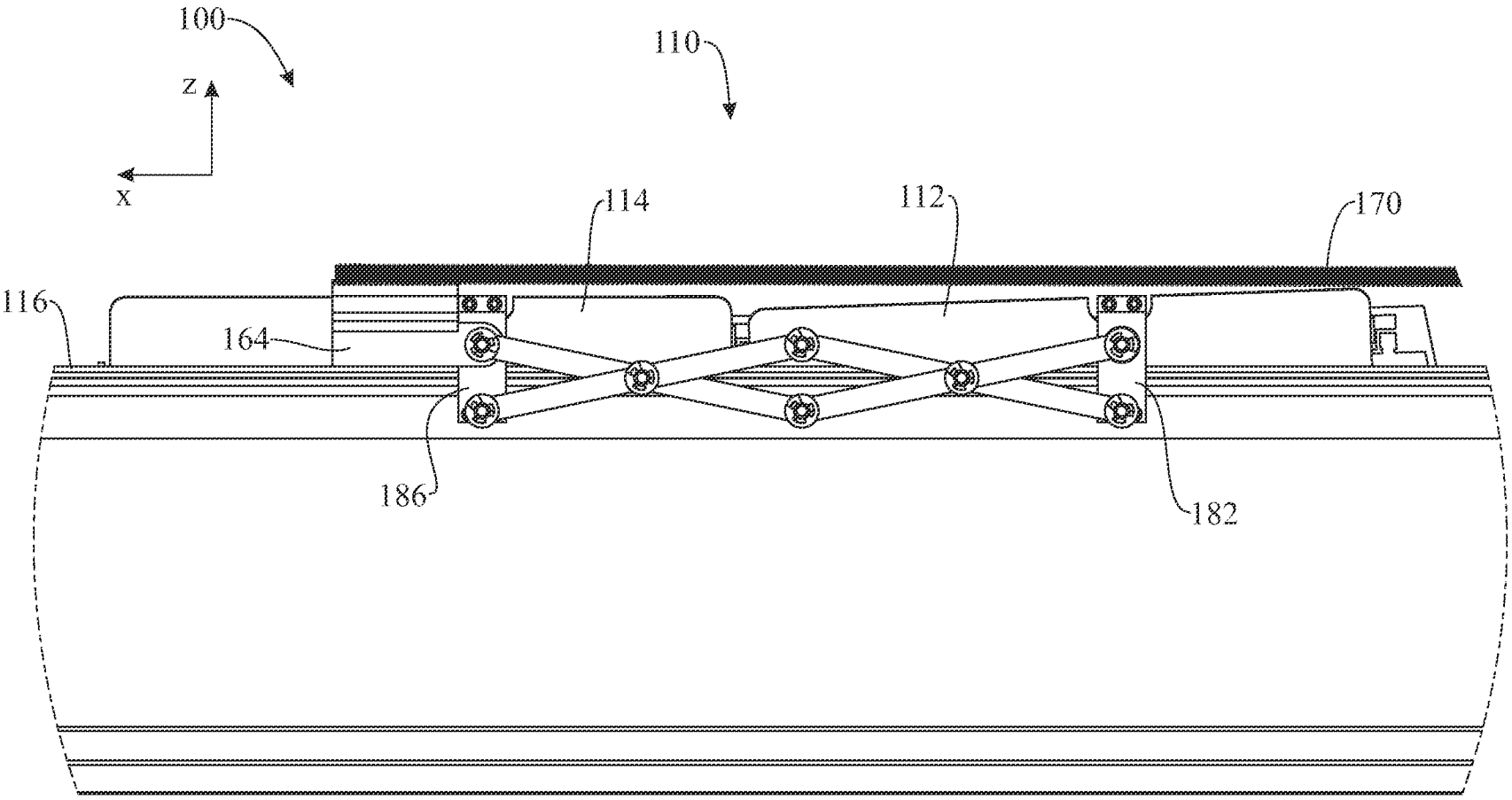
FIG. 9 presents a side elevation view of the louvered enclosure system of FIG. 6.

Turning now to FIGS. 7-9, in use, the louvered roof assembly 100 is initially positioned in a designated area or location where it is desired to have full partial shade or a waterproof roof over an area such as a deck or patio. The louvered roof assembly 100 may also be used above an otherwise open roof room. The louvered roof assembly 110 may be provided with decorative covers 270 (FIG. 1) covering the first and second rails 116 and 118 as well as hide the drive assembly 120 from view. When the user desires full light and the most amount of fresh air in the designated area, the louvered roof assembly 100 is maintained in the fully retracted condition (FIG. 7). Should the user desire to limit the amount of light or fresh air to the designated area, the louvered roof assembly 100 may be extended in the longitudinal direction x, as indicated by arrow B and described hereinabove (FIG. 8) to a partially extended condition by operation of the lead screw 170 of the drive mechanism 120.

While not specifically shown, the louvered roof assembly 100 may be extended to a fully expanded condition with the carriage 164 at a distal or farthest location and the scissor mechanism 122 fully expanded while maintaining the louver assemblies 110 in a vertical or open condition.

It should be noted that the rotation mechanism 180 can be operated at time or at any point along the longitudinal movement of the louver assemblies 110 to rotate the louver assemblies to a partially or fully closed condition (FIG. 9) in order to regulate the amount of sunlight and air reaching the designated area. I.e., the louver assemblies 110 are longitudinally movable (along longitudinal direction x) and rotationally movable (about respective rotation axes arranged in the transverse direction y), with said longitudinal and rotational movement being independent from one another. As shown in FIG. 9, the louver assemblies 110, including the first and second louver assemblies 112 and 114 have been rotated to the fully closed condition creating a watertight sealed roof above the designated area. It should be noted that each of the louver assemblies 110 are disconnected from each other when in an open or partially open condition to allow air flow therebetween.

Figure 10:
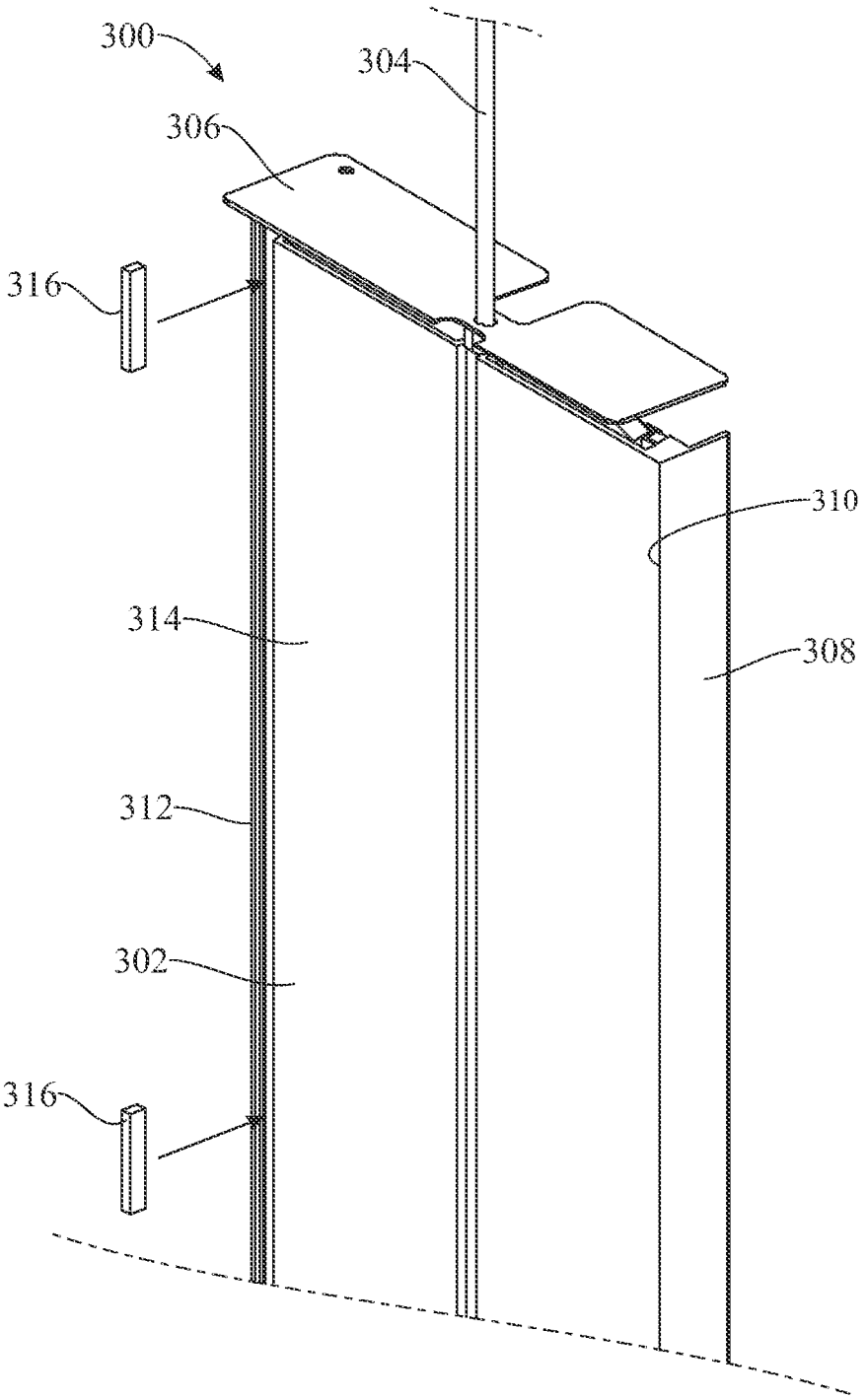
FIG. 10 presents a top, front isometric view of a louver assembly of a louvered enclosure system in accordance with an alternative embodiment of the present invention, the louver assembly incorporating magnets to maintain adjacent louver assemblies in a tightly closed condition.
Figure 11:
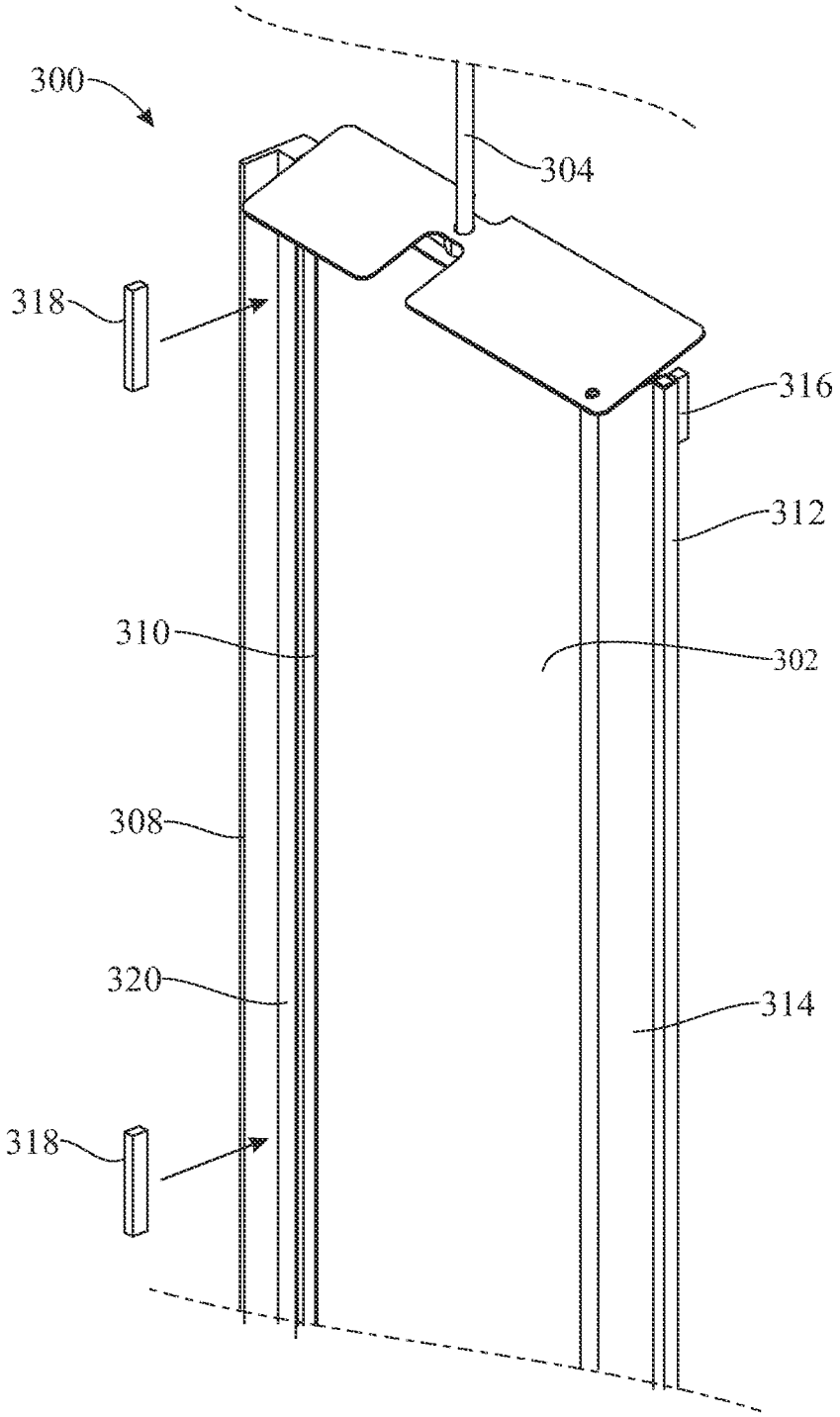
FIG. 11 presents a bottom, front isometric view of the louver assembly of the louvered enclosure system of FIG. 10, showing that a bottom side of the louver assembly also incorporates magnets.
Figure 12:
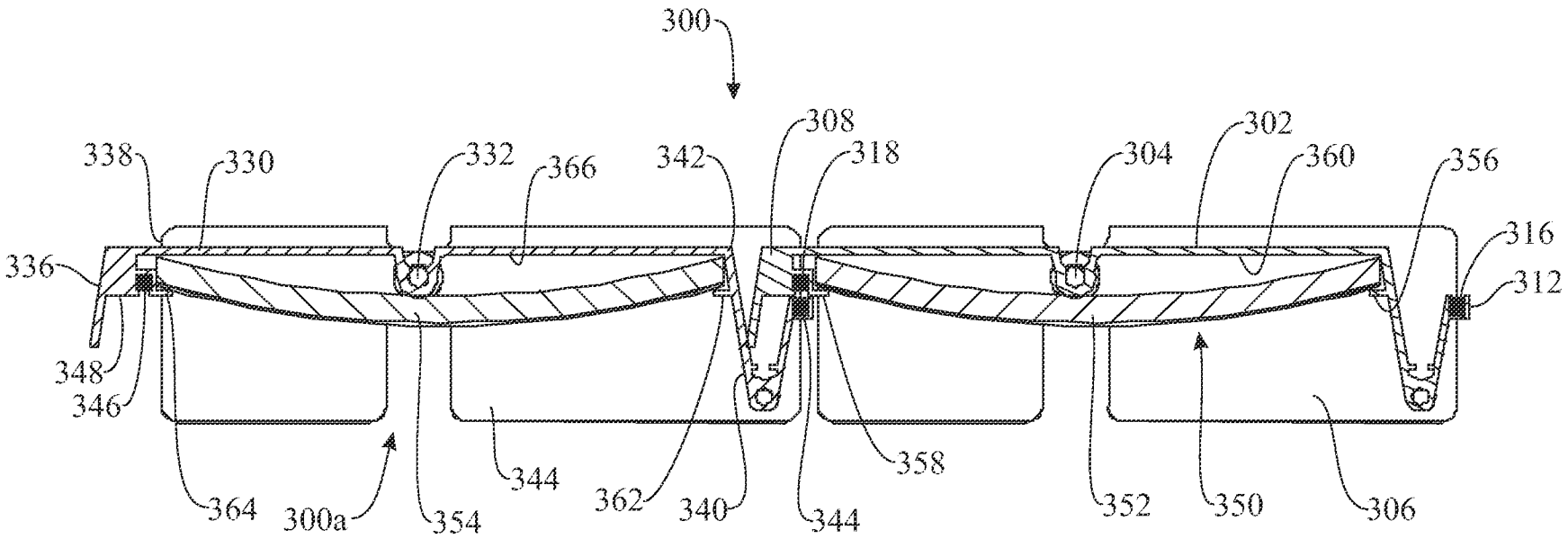
FIG. 12 presents a cross-sectional side elevation view of a pair of louver assemblies of the type shown in FIGS. 10 and 11, the louver assemblies depicted in an adjacent and fully closed condition which is maintained by the magnetic fastening provided by the magnets.

The illustrations of FIGS. 10-12 disclose an alternative embodiment of a louver assembly 300 for use in the louvered enclosure system 100. The louver assembly 300 is similar to the louver assembly 112 described hereinabove and generally includes a first louver panel 302 mounted on a drive pin 304. The louver assembly 300 also includes an end plate 306 and a longitudinally extending side panel 308 extending along a first edge 310 of the first louver panel 302. A hook 312 extends along a second edge 314 of the first louver panel 302.

In some embodiments, the first and second louver assemblies can be magnetically attachable to one another to maintain the first and second louver assemblies in the closed position of FIG. 6, in which the first and second assemblies have rotatably adopted a generally coplanar position relative to one another. For instance, in the present embodiment, one or more magnets are positioned along the sides of the first louver panel 302 to engage similar one or more magnets on a next adjacent louver panel. The magnets are arranged so that opposite poles attract and draw or tightly seal the adjacent panels together when rotated to the horizontal position or condition. Specifically, the louver assembly 300 includes magnets 316 positioned in the hook 312 extending along the second edge 314 of the first louver panel (FIG. 10). Additional magnets 318 are positioned along an underside 320 of the side panel 308 (FIG. 11). Alternative embodiments are contemplated, however, in which the first and second louver assemblies can be magnetically attachable by having at least one of the first and second louver assemblies made of a ferromagnetic material (e.g., steel, iron) and the other of the first and second louver assemblies comprise one or more magnets configured to magnetically attach to the ferromagnetic material. For example, the louver assemblies may be made of a ferromagnetic material and may include magnets to fix the louver assemblies to adjacent louver assemblies when in the closed position (similarly to FIG. 12). In non-limiting examples, the magnets described heretofore may include neodymium magnets, strip magnets, etc.

As best shown in FIG. 12, a second louver assembly 300*a* is provided including a second louver panel 330 and is constructed identically to the first louver panel 302 and includes a drive pin 332, an end plate 334 and a side panel 336 extending along a first edge 338 of the second louver panel 330. A hook 340 extends along a second edge 342 of the second louver panel. Similar to the first louver panel 302 above, the second louver panel 330 also includes magnets 344 positioned in the hook 340 and magnets 346 positioned along an underside 348 of the side panel 336.

As shown, when rotated to the horizontal condition, the first and second louver assemblies 300 and 300*a* are positioned such that the magnets 318 in the underside 320 of the side panel 308 of the first louver assembly 300 is attracted to the opposite pole of the magnets 344 positioned in the hook 340 of the second louver panel 330. In this manner, the use of magnets along the edges aids in drawing the edges of adjacent louver panels together to form a tight seal along their edges.

With continued reference to FIG. 12, various forms of thermal, acoustic and/or other insulation 350 may be provided on the louver panels described herein to create an insulated movable roof assembly. For example, longitudinally extending insulation panels or pads 352 and 354 may be provided on the first and second louver panels 302 and 330, respectively, such as facing a respective underside 360 and 366 of the first and second panels 302 and 330. Alternatively or additionally, insulation materials or pads could be provided on a top side of the louver panels and/or a different area of the louver panels. The insulation pad 352 may be retained in brackets 356 and 358 provided on the underside 360 of the first louver panel 302 and the insulation pad 354 may be retained in brackets 362 and 364 provided on the underside 366 of the second louver panel 330. While not expressly shown herein, said insulation pads may also be included in the first embodiment of FIGS. 1-9. In some embodiments, the insulation pads may be selectively removable, allowing the user to customize the degree of insulation provided by the louvered enclosure system 100.

Further embodiments of the invention are contemplated in which the plurality of louver assemblies may be covered by a water and/or thermal insulation fabric or panel extending over and along all or part of the plurality of louver assemblies.

Additional embodiments are contemplated in which a louvered enclosure system including rotatable louvers, whether slidable or non-slidable, are provided with a magnetic attachment between louvers such that when the louvers are arranged in a closed condition (similar to FIG. 6), the magnetic attachment maintains the louvers in the closed condition, one adjacent the other.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A louvered roof system for selectively covering a designated area, comprising:

a first rail and a second rail, the rails extending along a longitudinal direction and in parallel relationship with one another;

a plurality of louver assemblies extending between said first and second rails in a transverse direction perpendicular to said longitudinal direction, the plurality of louver assemblies mounted for longitudinal movement along said first and second longitudinally extending rails;

wherein each of the plurality of louver assemblies comprises a first gear mechanism and a second gear mechanism, wherein the first gear mechanism and the second gear mechanism each have a T-shaped shaft gear with an inwardly directed projection, wherein the T-shaped shaft gear is rotatably mounted on a control shaft connected to the first gear mechanism and to the second gear mechanism, and wherein the T-shaped shaft gear slides along a length of the control shaft; and an expandable and contractable drive assembly connected to the plurality of louver assemblies and configured to cause forward and rearward longitudinal movement of the plurality of louver assemblies along the first and second rails, wherein a longitudinal separation between the louver assemblies is adjustable responsively to expansion and contraction of the drive assembly, and wherein each louver assembly is rotatably connected to the drive assembly such that said each louver assembly is rotatable relative to the first and second rails about a respective rotation axis arranged in the transverse direction.

2. The louvered roof system of claim 1, further comprising an insulation material provided on the plurality of louver assemblies.

3. The louvered roof system of claim 1, further comprising a magnet arranged along opposed edges of a first louver assembly and along opposed edges of a second louver assembly, wherein the first louver assembly is co-planar to the second louver assembly.

4. The louvered roof system of claim 1, wherein the drive assembly comprises a scissor mechanism, wherein an end of each louver assembly of the plurality of louver assemblies is carried by the scissor mechanism and is pivotable relative to the scissor mechanism.

5. The louvered roof system of claim 4, wherein the scissor mechanism is arranged within one of the first and second rails.

6. The louvered roof system of claim 5, wherein a first end of the scissor mechanism is secured to said one of the first and second rails such that said first end of the scissor mechanism is not longitudinally movable along said one of the first and second rails as the scissor mechanism expands or contracts.

7. The louvered roof system of claim 4, wherein the drive assembly further comprises: a longitudinally movable carriage attached to the scissor mechanism; and a rotatable lead screw in threaded engagement with said carriage such that rotation of the lead screw selectively drives the carriage longitudinally frontward or rearward to expand or contract the scissor mechanism, respectively.

8. The louvered roof system of claim 7, wherein the carriage is connected to a specific louver assembly of the plurality of louver assemblies arranged frontward of other louver assemblies of the plurality of louver assemblies.

9. The louvered roof system of claim 4, wherein the drive assembly further comprises:

a plurality of worm gears attached to the scissor mechanism, the plurality of worm gears comprising a respective worm gear associated to each louver assembly of the plurality of louver assembles, wherein said each louver assembly associated to the respective worm gear is rotatably carried by said respective worm gear; and a control shaft engaged with the plurality of worm gears such that the worm gears are slidable along the control shaft and are jointly rotatably with the control shaft about a central longitudinal axis of the control shaft, such that rotation of the control shaft about the central longitudinal axis of the control shaft is converted to a rotation of each louver assembly by the respective worm gear.

10. The louvered roof system of claim 9, wherein the control shaft comprises a longitudinally extending slot configured to longitudinally slidably receive a radially inwardly directed projection formed in each worm gear.

11. The louvered roof system of claim 9, wherein each louver assembly of the plurality of louver assemblies comprises a respective pin at an end of said each louver assembly, wherein the pin is formed along the transverse direction and is engaged with the respective worm gear of said each louver assembly such that rotation of the respective pin by the respective worm gear drives said each louver assembly to rotate.

12. The louvered roof system of claim 9, wherein the drive assembly further comprises:

a longitudinally movable carriage attached to the scissor mechanism and to a specific louver assembly of the plurality of louver assemblies arranged frontward of other louver assemblies of the plurality of louver assemblies, wherein the carriage is further attached to the respective worm gear associated to said specific louver assembly; and a rotatable lead screw in threaded engagement with said carriage such that rotation of the lead screw selectively drives the carriage longitudinally frontward or rearward to expand or contract the scissor mechanism, respectively.

13. The louvered roof system of claim 12, wherein each louver assembly of the plurality of louver assemblies comprises a respective pin at an end of said each louver assembly, wherein the pin is formed along the transverse direction and is engaged with the respective worm gear of said each louver assembly such that rotation of the respective pin by the respective worm gear drives said each louver assembly to rotate, and further wherein the respective worm gear of the specific front louver assembly and the carriage are connected to the respective pin of the specific front louver assembly.

14. A louvered roof system for selectively covering a designated area, comprising:

a first rail and a second rail, the rails extending along a longitudinal direction and in parallel relationship with one another;

a plurality of louver assemblies extending between said first and second rails in a transverse direction perpendicular to said longitudinal direction, the plurality of louver assemblies mounted for longitudinal movement along said first and second longitudinally extending rails;

wherein each of the plurality of louver assemblies comprises a first gear mechanism and a second gear mechanism, wherein the first gear mechanism and the second gear mechanism each have a T-shaped shaft gear with an inwardly directed projection, wherein the T-shaped shaft gear is rotatably mounted on a control shaft connected to the first gear mechanism and to the second gear mechanism, and wherein the T-shaped shaft gear slides along a length of the control shaft; and an expandable and contractable scissor mechanism connected to the plurality of louver assemblies and configured to cause forward and rearward longitudinal movement of the plurality of louver assemblies along the first and second rails, wherein a longitudinal separation between the louver assemblies is adjustable responsively to expansion and contraction of the scissor mechanism, and wherein each louver assembly is rotatably connected to the scissor mechanism such that said each louver assembly is rotatable relative to the first and second rails about a respective rotation axis arranged in the transverse direction.

15. A louvered roof system for selectively covering a designated area, comprising:

a first rail and a second rail, the rails extending along a longitudinal direction and in parallel relationship with one another;

a plurality of louver assemblies extending between said first and second rails in a transverse direction perpendicular to said longitudinal direction, the plurality of louver assemblies mounted for longitudinal movement along said first and second longitudinally extending rails;

wherein the first gear mechanism and the second gear mechanism each have a T-shaped shaft gear with an inwardly directed projection, wherein the T-shaped shaft gear is rotatably mounted on a control shaft connected to the first gear mechanism and to the second gear mechanism, and wherein the T-shaped shaft gear slides along a length of the control shaft; and an expandable and contractable scissor mechanism arranged within one of the first and second rails and connected to an end of the plurality of louver assemblies, wherein the scissor mechanism is configured to cause forward and rearward longitudinal movement of the plurality of louver assemblies along the first and second rails, wherein a longitudinal separation between the louver assemblies is adjustable responsively to expansion and contraction of the scissor mechanism, and wherein each louver assembly is rotatably connected to the scissor mechanism such that said each louver assembly is rotatable relative to the first and second rails about a respective rotation axis arranged in the transverse direction.

* * * * *